US011892009B2

(12) United States Patent
Zhou

(10) Patent No.: US 11,892,009 B2
(45) Date of Patent: Feb. 6, 2024

(54) BLADE-HEATING HEAT PUMP COVER AND HEAT PUMP

(71) Applicant: BACKER HEATING TECHNOLOGIES (SHENZHEN) CO., LTD., Shenzhen (CN)

(72) Inventor: Zaixing Zhou, Shenzhen (CN)

(73) Assignee: BACKER HEATING TECHNOLOGIES (SHENZHEN) CO., LTD.

( * ) Notice: Subject to any disclaimer, the term of this patent is extended or adjusted under 35 U.S.C. 154(b) by 0 days.

(21) Appl. No.: 18/117,148

(22) Filed: Mar. 3, 2023

(65) Prior Publication Data

US 2023/0296106 A1 Sep. 21, 2023

(30) Foreign Application Priority Data

Mar. 16, 2022 (CN) ..... 202210257565.2

(51) Int. Cl.
*F04D 29/40* (2006.01)
*F04D 29/58* (2006.01)
*F25B 30/00* (2006.01)

(52) U.S. Cl.
CPC ..... *F04D 29/406* (2013.01); *F04D 29/588* (2013.01); *F25B 30/00* (2013.01)

(58) Field of Classification Search
CPC ..... F04D 29/406; F04D 29/588; F25B 30/00
See application file for complete search history.

(56) References Cited

U.S. PATENT DOCUMENTS

| | | | | |
|---|---|---|---|---|
| 10,302,098 | B2 * | 5/2019 | Li | F04D 29/588 |
| 10,602,905 | B2 * | 3/2020 | Li | A47L 15/08 |
| 10,724,547 | B2 | 7/2020 | Zoppas et al. | F04D 15/00 |
| 10,941,962 | B2 * | 3/2021 | Teufl | H05B 3/78 |

FOREIGN PATENT DOCUMENTS

| | | | |
|---|---|---|---|
| CN | 205398985 | 7/2016 | D06F 39/04 |
| CN | 109804166 | 11/2020 | F04D 15/00 |
| CN | 109681473 | 4/2021 | F04D 29/58 |

* cited by examiner

*Primary Examiner* — Brian O Peters
(74) *Attorney, Agent, or Firm* — HAYES SOLOWAY P.C.

(57) ABSTRACT

Disclosed are a blade-heating heat pump cover and a heat pump. The blade-heating heat pump cover comprises a cover body having a first surface in contact with liquid and a second surface opposed to the first surface. The heat pump cover further comprises a heating element having a first end on one side of the first surface, and a second end passes through the cover body and protrudes from the second surface. The second end is provided with an electrical connection section used for energizing. The first end comprises a heating section and a non-heating section, the non-heating section is on one side of the heating section away from the second end, and the non-heating section is connected to the heating section.

16 Claims, 7 Drawing Sheets

BLADE-HEATING HEAT PUMP COVER AND HEAT PUMP

CROSS-REFERENCE TO RELATED APPLICATION

This application claims priority to Chinese Patent Application No. 202210257565.2, filed on Mar. 16, 2022, the content of all of which is incorporated herein by reference.

TECHNICAL FIELD

The disclosure relates to the technical field of heat pump equipment, in particular to a blade-heating heat pump cover and a heat pump.

BACKGROUND

In the prior art, a heat pump is commonly used in household appliance, such as in a dishwasher where the heat pump is an important part of the dishwasher. In the current heat pump, a heating element is adapted to be connected to a pump cover, the pump cover is engaged with a pump body to form a water chamber, when the heating element is electrically heating, the water flow through the water chamber is heated and then released.

At present, heating tubes of heat pumps on the market are tubular heaters, but the water resistance is high when using the tubular heaters. In addition, in order to reduce the power density, the heating tube is designed as a double-loop and spiral structure, and the structure is multi-loop superimposed in the axial direction. This form of heater reduces the power density, but increases the length in the axial direction of a pump, so the form of heater is not conducive to be applied to a compact pump for dishwasher.

Therefore, the existing technology still needs to be developed.

BRIEF SUMMARY

The present disclosure aims to provide a blade-heating heat pump cover and a heat pump, to solve the technical problem that the heating tube of the prior art is designed as a double-loop and spiral structure, and the structure increases the length in the axial direction, which is unfavorable to be applied to the compact pumps for dishwashers.

To realize the aim above, the technical solution of the present disclosure is as follows:

On the one hand, the present disclosure provides a blade-heating heat pump cover, which comprises: a cover body, the cover body has a first surface in contact with liquid and a second surface opposed to the first surface, the heat pump cover further comprises a heating element, the heating element has a first end on one side of the first surface, and a second end passes through the cover body and protrudes from the second surface, the second end is provided with an electrical connection section, the electrical connection section is used for energizing;

The first end comprises a heating section and a non-heating section, the non-heating section is on one side of the heating section away from the second end, and the non-heating section is connected to the heating section.

In one embodiment, a length of the non-heating section is 2 mm-80 mm.

In one embodiment, the heating element has a connection area, and the connection area is fixedly connected to the first surface;

The heat pump cover further comprises a temperature-controlling assembly, the temperature-controlling assembly is electrically connected to the electrical connection section;

The temperature-controlling assembly comprises a safety device, the safety device is connected to a position on the second surface corresponding to the connection area.

In one embodiment, the heating section is the connection area, the heating section is fixedly connected to the first surface.

In one embodiment, the heating section is welded to the first surface or is fixedly connected to the first surface by a temperature-sensing layer.

In one embodiment, the non-heating section is connected to the first surface or is set at intervals with the first surface.

In one embodiment, a length of the heating element along a radial direction is greater than a length of the heating element along an axial direction.

In one embodiment, a ratio of the length of the heating element along the radial direction to the length of the heating element along the axial direction is not less than 2.3.

In one embodiment, the heating element has a heating body area, the heating body area is provided between the first end and the second end, the heating body area and the first end form a contour in a shape of an open ring;

The heating element has a connecting reinforcement connected between a bending section of the second end and the first end, the connecting reinforcement is located at an opening between the heating body area and the first end.

In one embodiment, the electrical connection section comprises a first wiring post and a second wiring post;

The heating element comprises a heating sheath, and a heating wire inside the heating sheath, two ends of the heating wire are respectively connected to the first wiring post and the second wiring post.

In one embodiment, the cover body is provided with a convex section, the second end comprises a bending section and an extension section, the bending section is bent into the convex section and penetrates the convex section by the extension section, the extension section of the second end is sealingly connected to a penetration of the convex section.

In one embodiment, a power density at the bending section and a power density at a part of the extension section inside the convex section are both less than a power density at the heating section.

In one embodiment, the heating element has a heating body area, the heating body area is provided between the first end and the second end, the heating body area of the heating element and the first surface are set at intervals, the heating body area and the first surface are connected by one support or a plurality of supports.

In one embodiment, a position of the heating body area connected to the supports is the connection area.

In one embodiment, the heating body area of the heating element and the first surface are set at intervals, at least one welded position is between the heating body area and the first surface, the welded position of the heating body area is the connection area.

In one embodiment, the temperature-controlling assembly further comprises a temperature-sensing substrate, the temperature-sensing substrate is connected to the second surface;

A temperature controller, the temperature controller is connected to the temperature-sensing substrate, and a bottom of the temperature controller is attached to the second surface;

A safety device, the safety device is connected to the temperature-sensing substrate, and a bottom of the safety device is attached to the second surface;

A control plug, the control plug is fixedly set on the temperature controller and the safety device, two sides of the control plug are respectively provided with reinforcement bars, the first wiring post and the second wiring post are respectively electrically connected to a first plug and a second plug set on the two sides of the control plug in a circuit connection; and The control plug also comprises a third plug and a fourth plug, the third plug and the fourth plug are set at intervals, the third plug and the fourth plug are respectively electrically connected to the temperature controller and the safety device.

On the other hand, based on the same idea, the present disclosure further provides a heat pump, the heat pump comprises a pump body and the heat pump cover disclosed above; the heat pump cover is detachably connected to the pump body.

The beneficial effects of a blade-heating heat pump cover and a heat pump provided by the present disclosure are at least as follows: (1) by providing the heating element on one side of the first surface, the water flow in the cover body is heated, only the second end of the heating element extends and protrudes to the second surface, so as to be electrically connected through the electrical connection section; (2) by extending one end out of the cover body, the connection area between the end and the cover body is smaller, thus the water resistance is reduced, and the water flow on one side of the first surface is stable; (3) by connecting just the second end to the cover body while one side of the first end extending on the first surface, and including a heating section and a non-heating section in the first end, the non-heating section is on one side of the heating section away from the second end, so as to heat liquid through the heating section, thus forming a single-layer heating structure, which is conducive to reduce the size of the heat pump cover along the axial direction, thus achieving a miniaturization of the structure and a more compact pump axially, and saving space, so that the dishwashers can have more space to accommodate the dishes than those with heat pumps of other technologies.

BRIEF DESCRIPTION OF THE DRAWINGS

In order to more clearly illustrate the technical solutions in the embodiments of the present disclosure, the following is a brief description of the drawings that need to be used in the description of the embodiments or the prior art. It is obvious that the drawings in the following description are only some embodiments of the present disclosure, and other drawings can be obtained according to the drawings of the present disclosure without creative work for those skilled in the art.

Attachment marks: 100. cover body; 110. first surface; 120. second surface; 130. water inlet; 131. enclosed edge; 200. convex section; 210. recess; 220. seal; 300. temperature-controlling assembly; 310. temperature controller; 320. safety device; 330. fixed plate; 340. control plug; 350. first plug; 351. second plug; 352. third plug; 353. fourth plug; 400. heating element; 410. first end; 411. connection area; 412. heating section; 413. non-heating section; 420. heating body area; 421. support; 430. second end; 431. bending section; 432. extension section; 440. first wiring post; 441. second wiring post; 450. temperature-sensing layer; 460. heating sheath; 470. heating wire; 500. connecting reinforcement; 510. first connecting buckle; 520. connecting piece; 530. second connecting buckle; 600. sealing section; 610. first bending section; 611. limiting slot; 620. second bending section; 621. sealing space; 630. sealing ring; 700. pump body.

DETAILED DESCRIPTION OF EMBODIMENTS

In order to make the technical solutions, beneficial effects of the present disclosure and the technical problems to be solved by the present disclosure more clearly understood, embodiments and drawings are given below to further illustrate the implementations of the present disclosure. It is to be understood that the embodiments described herein are merely illustrative of the present disclosure and are not intended to be limiting.

It is noted that when a component is referred to as "fixed to" or "set on" another component, the component may be directly or indirectly located on another component. When a section is referred to be "attached" to another section, the section may be directly or indirectly attached to another section. The terms "top", "bottom", "left", "right", "front", "back", "vertical", "horizontal", "bottom", "top", "inside", "outside", etc. are based on the orientation or position shown in the accompanying drawings and are only for descriptive purposes and are not to be construed as a limitation of the present technical solutions. The terms "first" and "second" are only used for descriptive purposes and are not to be construed as indicating or implying relative importance or implicitly specifying the number of technical features. The term "plurality" means two or more, unless otherwise clearly and specifically limited.

Figure 1:
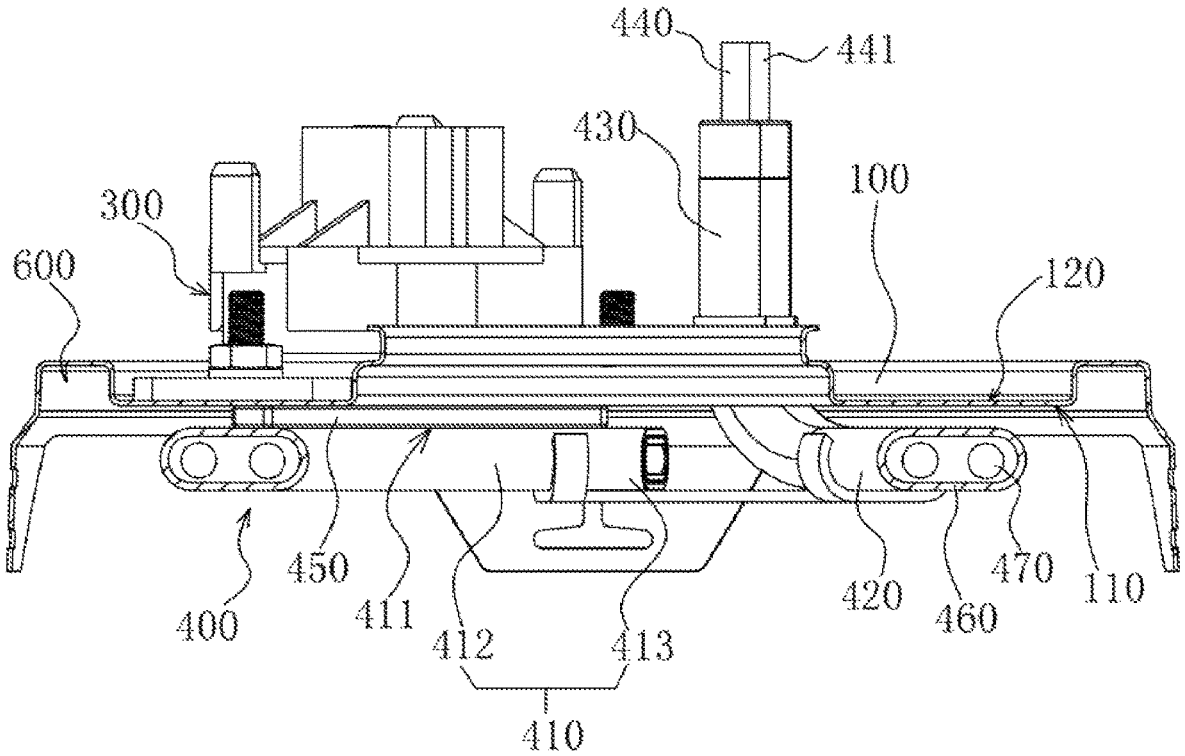
FIG. 1 is a cross-sectional view of a blade-heating heat pump cover provided by an embodiment of the present disclosure.
Figure 3:
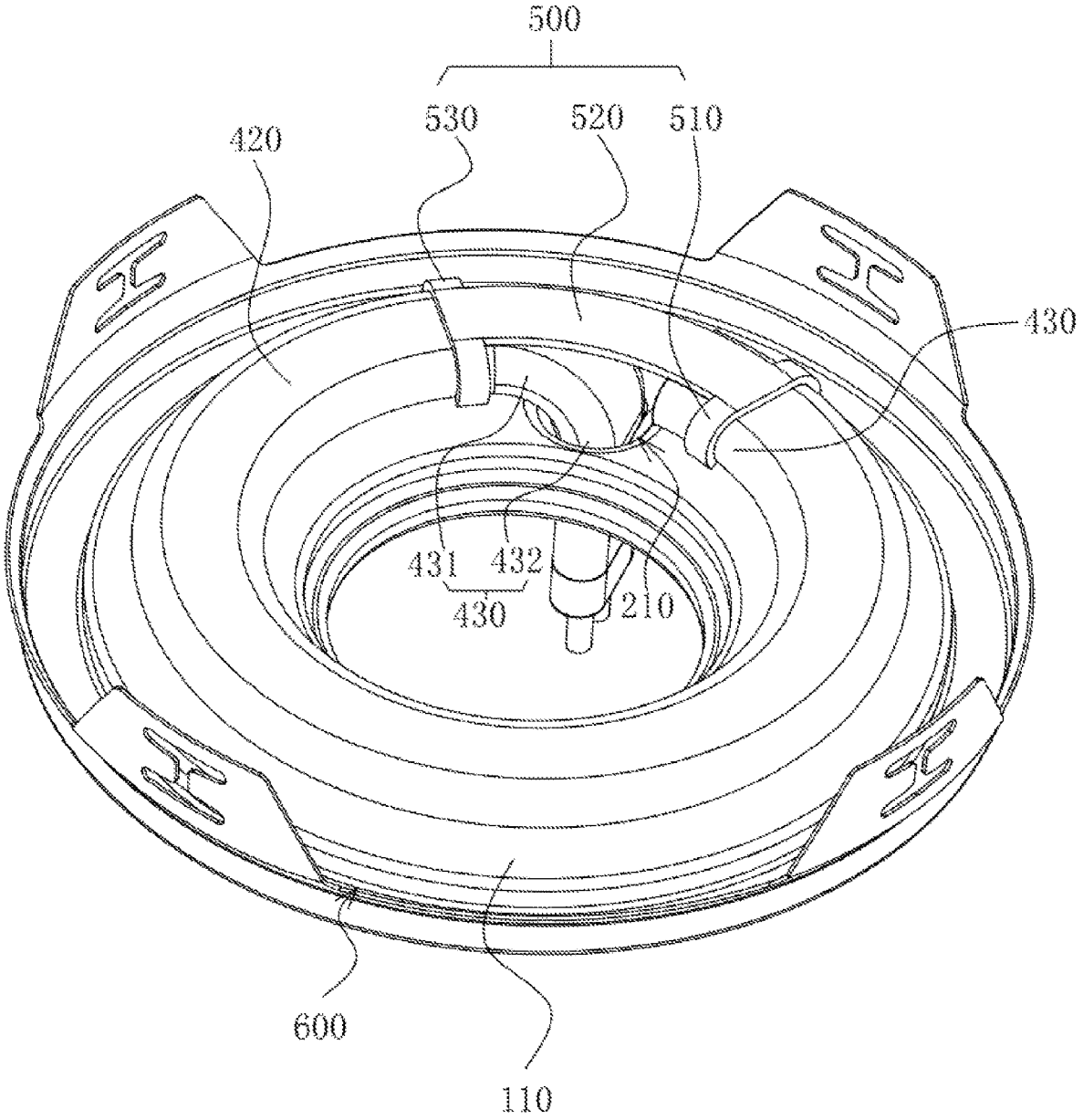
FIG. 3 is a schematic diagram of the structure of another view of a blade-heating heat pump cover by an embodiment of the present disclosure.

As shown in FIG. 1 and FIG. 3, this embodiment provides a blade-heating heat pump cover, comprising a cover body 100, a temperature-controlling assembly 300. The cover body 100 has a first surface 110 in contact with liquid, and a second surface 120 opposed to the first surface 110. Take the heat pump in use when placed vertically as an example, the first surface 110 is the lower surface of the cover body 100, and one side of the first surface 110 is the inside pf the pump body 700, and the inside of the pump body 700 has liquid (such as water) flowing, and the second surface 120 is the upper surface, and one side of the second surface 120 is the outside of the pump body 700. In this embodiment, the shape contour of the cover body 100 is circular, and the axial direction of the circular cover body 100 is used as the axial direction in the structural description, and the radial direction of the cover body 100 is used as the radial direction in the structural description. In this embodiment, the heat pump cover also comprises a heating element 400. The heating element has a first end 410 on one side of the first surface 110, a heating body area 420 connected to the first end 410, and a second end 430 connected to the heating body area 420 and passing through the cover body 100 and protruding from the second surface 120. The second end 430 is provided with an electrical connecting section, and the electrical connection comprises a first wiring post 440 and a second wiring post 441, and the first wiring post 440 and the second wiring post 441 are separately electrically connected to the temperature-controlling assembly 300 to make the heating element 400 be electrically connected, and the electric current enters the heating element 400 through the control of the temperature-controlling assembly 300 to achieve electrical heating. The second end 430, the heating body area 420 and the first end 410 of the heating element 400 can be set in one piece, or can be welded in sections. The first end 410 comprises a heating section 412, and a non-heating section 413, and the non-heating section 413 is located on the side of the heating section 412 which is away from the second end 430, and the non-heating section 413 is connected to the heating section 412.

The blade-heating heat pump cover provided in this embodiment works as follows: the water flow in the cover body 100 is heated by providing the heating element 400 on one side of the first surface 110, and only the second end 430 of the heating element 400 extends and protrudes to the second surface 120 to be electrically connected through the electrical connecting section; one end is used to extend out of the cover body 100, so that a connection area 411 of the end connected to the cover body 100 is smaller, reducing the water resistance and stabilizing the water flow located on one side of the first surface 110. Only the second end 430 is connected to the cover body 100 while the first end 410 extends on one side of the first surface 110, and the first end 410 heats the liquid through the heating section 412, thus forming a single-layer heating structure, which is conducive to reducing the size of the heat pump cover along the axial direction, thus achieving a miniaturization of the structure, a more compact axial direction of the heat pump, and saving space, so that dishwashers can have more space to accommodate the dishes than heat pumps of other technologies.

Further, the heating element 400 also has a connection area 411, and the connection area 411 is fixedly attached to the first surface 110, and the heating element 400 is in contact with the first surface 110 through the connection area 411 to facilitate heat conduction; the temperature-controlling assembly 300 comprises a safety device 320, and the safety device 320 may be a fuse. The safety device 320 is connected to the position of the second surface 120 corresponding to the connection area 411, so that the heat conducted by the connection area 411 can be quickly sensed by the temperature-controlling assembly 300 which improves the sensitivity of sensing.

Further, the first end 410 has not only a heating section 412 but also a non-heating section 413. In this scheme, the heating section 412 is used as the connection area 411, and the heating section 412 is fixedly connected to the first surface 110 by the temperature-sensing layer 450, or the heating section 412 is directly connected to the first surface 110 by welding. In this way, one end of the heating element 400 on one side of the first surface 110 is connected to the cover body 100, and the gap between the first end 410 and the first surface 110 is filled by the temperature-sensing layer 450, which facilitates heat conduction while a part of the heating element 400 on one side of the first surface 110 is on the same axial level which reduces the water resistance. Temperature-sensing layer 450 may be a temperature-sensing plate or a temperature-sensing sheet. By welding the temperature-sensing layer 450 directly with the first end 410 and the first surface 110, a fixed connection is achieved.

It should be noted that the connection area 411 may not be provided at the first end 410, but may also be part of the heating body area 420. The connection area 411 may also be welded directly to the first surface 110 of the cover body 100, directly bringing the heating element 400 into contact with the first surface 110. The connection area 411 may also be the upper surface of the entire heating body area 420 and the first end 410, i.e. the heating element 400 is attached to and in contact with the first surface 110 through the connection area 411 in whole or in part, to make the safety device 320 of the temperature-controlling assembly 300 be connected to the second surface 120 and corresponds to the position of the connection area 411 (which may make the safety device 320 contact on the cover body 100 directly opposite the connection area 411).

As shown in FIG. 1, the non-heating section 413 is located at the end of and connected to the heating section 412, and the non-heating section 413 and the first surface 110 are set at intervals. Or the non-heating section 413 and the first surface 110 are set in connection, and the connection between the non-heating section 413 and the first surface 110 is without any gaps. By providing the non-heating section 413, the non-heating section 413 only conducts heat, so that the temperature-controlling assembly 300 in the upper part of the connection area 411 can detect the water temperature in the pump body 700 through the heat conduction of the non-heating section 413, which is sensitive to both the water temperature and the temperature of the heating element 400, and improves the temperature measurement degrees and makes the whole heat pump cover compact.

Further, the length of the non-heating section 413 is not less than 2 mm, for example, the length of the non-heating section 413 may be set to 2 mm-80 mm. The setting of the length of the non-heating section 413 may set a suitable ratio of the non-heating section 413 and the heating section 412 in the connection area 411 through the power density at the heating element 400, so as to determine the optimal temperature-controlling layout and improve the accuracy of the temperature-controlling assembly to control the water temperature in the pump.

Further, the length of the heating element 400 along the radial direction is greater than the length of the heating element 400 along the axial direction. Taking the cross-section of the heating element 400 as an example, the length of the radial direction of the heating element 400 is greater than the thickness of the upper and lower directions of the heating element 400, so that the entire heating element 400 is a flat structure. When the water flow is heated, the distance in the axial direction of the flat heating element 400 is small, so that when the water flows, the blocking surface to the water flow is small, so as to reduce the water resistance, and make the water flow stable, and improve the efficiency of the pump. Moreover, the flat heating element 400 makes the heating element 400 thinner in the axial direction, so that the distance from the heating wire to the surface of the heating element is close, and the thermal resistance is small, and the speed of the water flow on the upper and lower surfaces is faster than the traditional round heating element, thus making it easy to conduct heat from the heating element 400 to the water, and making the thermal response faster, and the surface temperature of the flat heating element 400 is low at the same power density, and the life of the flat heating element 400 is long and the thermal efficiency of the flat heating element 400 is high. By providing a connection area 411 on the heating element 400 and making the connection area 411 connected or in contact with the cover body 100 (the heating element 400 is in full or partial contact with the first surface 110 through the connection area 411), which enables the heat of the heating element 400 to be conducted directly through the connection area 411, and also enables the heat of the water near the connection area 411 to be conducted to the temperature-controlling assembly 300 on the second surface 120, thus monitoring the water temperature in the pump body 700 and making the temperature-controlling assembly 300 act in time to avoid causing safety accidents in abnormal conditions (such as no water or little water). And providing the flat heating element 400 is more conducive to reducing the size of the heat pump cover along the axial direction, so as to achieve the miniaturization of structures, and achieve the compact of the axial direction of the pump, so as to save space.

A new heat pump cover design is used in this embodiment that takes into account the size and improves the efficiency of the pump and thermal efficiency. By one end of the heat pump cover extends out of the cover body 100, the connection area 411 with the cover body 100 is smaller and reduces water resistance. By the distance of the flat structure of the heating element 400 in the axial direction is small, so that when the water flows, the blocking surface to the water flow is small, which can reduce the water resistance and make the water flow stable, and the contact area of the water flow with the heating element 400 is large, thus improving the efficiency of the pump and thermal efficiency. Moreover, the flat heating element 400 makes the heating element 400 thinner in the axial direction and the thermal resistance is relatively small, thus making it easy to conduct heat from the heating element 400 to the water, resulting in faster thermal response, lower surface temperature at the same power density, long life, and high thermal efficiency.

Further, the size of the flat heating element 400 is large along the radial direction, and the ratio of the length of the heating element 400 along the radial direction to the length of the heating element 400 along the axial direction in this embodiment is not less than 2.3. The cross-sectional contour of one side of the heating element 400 is long-bar (e.g., rectangular, or rectangular with rounded corners, or elliptical), so as to make the flat heating element 400 be a thin sheet structure. With the radial size of the long-bar contour as the width and the axial length as the height, it adopts a width-to-height ratio of more than 2.3, and is a regular sheet in the direction of the pump's water discharge (radial) relative to the axial direction, effectively reducing water resistance, increasing the water flow rate, improving the pump's efficiency, and achieving good heat production and heat conduction, and the flat heating element 400 makes full use of the space of the first surface 110 of the cover body 100 to improve the heating efficiency.

A size in one example is: a width of the heating element 400 cross-section is 13 mm, a height of the heating element 400 cross-section is 5.5 mm, the width to the height ratio is 2.36.

Figure 4:
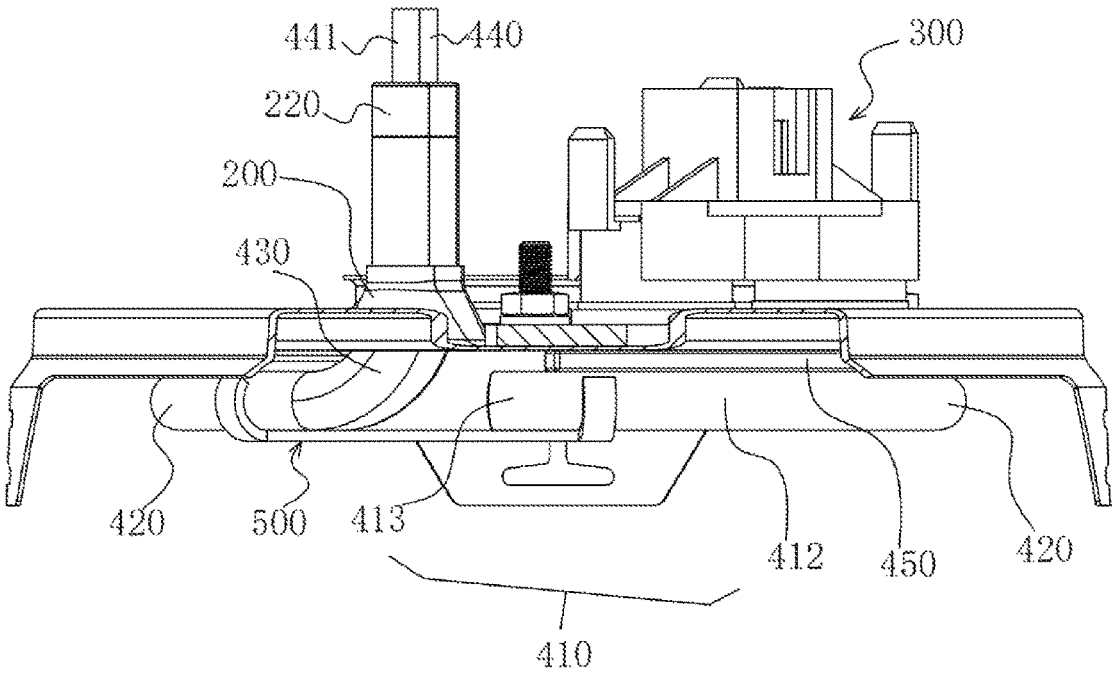
FIG. 4 is a cross-sectional view of another position of a blade heated heat pump cover provided by an embodiment of the present disclosure.

Further, as shown in FIG. 3 and FIG. 4, a contour formed by the heating body area 420 of the heating element 400 and the first end 410 is an open-ring shape. By using the heating element 400 with an open-ring shape, the heating element 400 matches the cover body 100, and the heating element 400 has a uniform contact surface to the flowing water in the pump, so that the flowing water is heated more uniformly.

Figure 5:
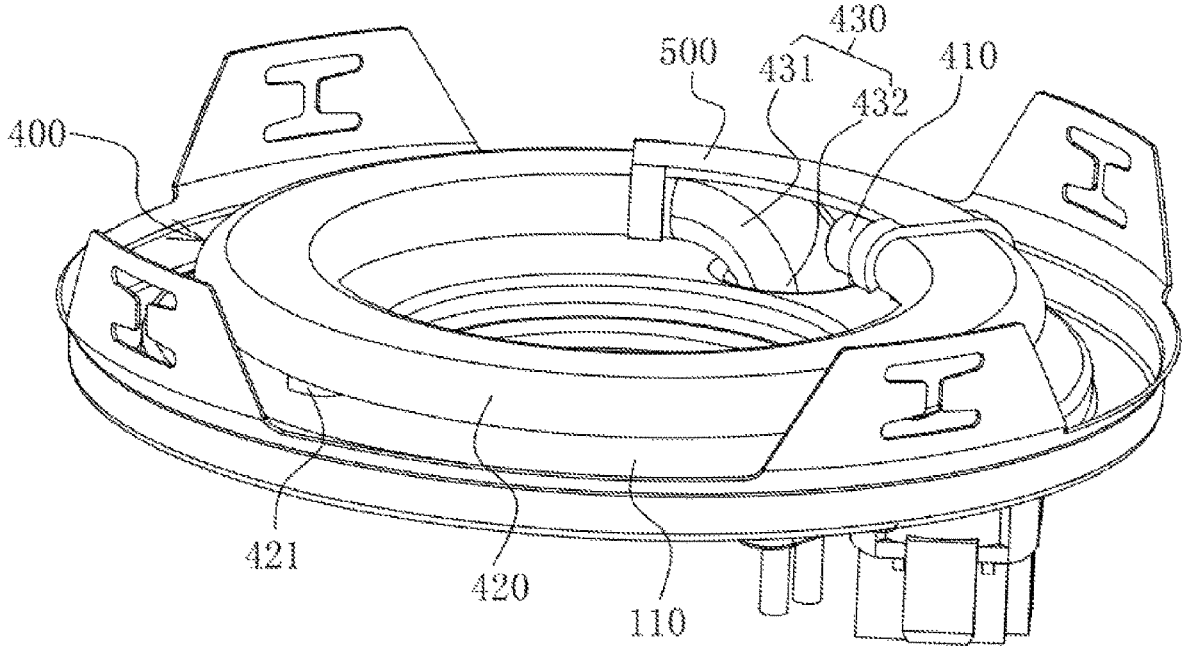
FIG. 5 is a schematic diagram of the structure of the bottom of a blade-heating heat pump cover provided by an embodiment of the present disclosure.

Further, as shown in FIG. 4 and FIG. 5, a bending area of the second end 430 of the heating element 400 is connected to the first end 410 by a connecting reinforcement 500, and the connecting reinforcement 500 is located at an opening between the heating body area 420 and the first end 410. By connecting the connecting reinforcing 500 to make up for the opening at a combination between the bending area of the second end 430 and the first end 410, the structure located on one side of the first surface 110 forms a complete circular shape, so that the water flow can follow the contour of the circular shape for smooth flow to reduce turbulence, thus reducing water resistance and improving the efficiency of the pump.

In a specific structure, the connecting reinforcement 500 comprises a first connecting buckle 510, a connecting piece 520, and a second connecting buckle 530. The first connecting buckle 510, the connecting piece 520, and the second connecting buckle 530 are integrally formed, and the first connecting buckle 510 is set fixed on the first end 410, and the second connecting buckle 530 is set fixed on the bending area of the second end 430, so that the connecting piece 520 is located at the opening. The connecting reinforcement 500 is a heat-conducting assembly with good heat-conducting property, thus increasing a heat-conducting area of the heat-conducting assembly through the connecting piece 520, so that a heat on the heating element 400 can be conducted to the connecting piece 520, and the connecting piece 520 is in contact with the water flow, thus conducting the heat to the water flow and increasing the heat-conducting efficiency. The connecting piece 520 is set in an arc shape, and the arc-shaped connecting piece 520 and the first surface 110 are set at intervals, so as to enable the heat to be conducted to the water flow by between the upper and lower surfaces of the connecting piece 520, further enhancing the heat conduction efficiency.

Both the first connecting buckle 510 and the second connecting buckle 530 can be welded and fixed to the heating element 400, so as to ensure that the connecting reinforcement 500 and the heating element 400 can be firmly connected, and when the first end 410 has a non-heating section 413, the non-heating section 413 is in an overhanging state at one end. By connecting the connecting reinforcement 500 to the non-heating section 413 of the first end 410 of one end and the second end 430, so that the heating element 400 is connected into a ring-shaped whole, which enhances the structural strength of the whole ring-shaped heating element 400, and the whole ring-shaped heating element 400 has a strong ability to resist the impact of water flow, thus reducing the vibration caused by water flow and improving the property of the pump.

Further, as shown in FIG. 1, the first wiring post 440 and the second wiring post 441 of the electrical connection in this embodiment can be respectively used as a fire wire and a zero wire of Alternating Current. The heating element 400 in this embodiment comprises: a heating sheath 460, and a heating wire 470 located inside the heating sheath 460. The heating wire 470 is wrapped by the heating sheath 460, and at least one heating wire 470 can be used, and the heating wire 470 has two ends, and the two ends are respectively connected with the first wiring post 440 and the second wiring post 441 to power up. For example, when one of the heating wire 470 is used, a part of the heating wire 470 located between the two ends is bent back and forth within the heating sheath 460 so that a radial side-by-side arranged structure of the heating wire 470 formed. Because the heating wire 470 is arranged within the heating sheath 460, and a distance between the heating wire 470 and the heating sheath 460 is small, thermal response is fast. And by using the radial side-by-side arranged structure of the heating wire 470, the heating wire 470 in the same power density can quickly conduct heat to water through the heating sheath 460, thus resulting in low surface temperature, long life, and high thermal efficiency.

In an alternative structure, as shown in FIG. 1, the heating wire 470 is set as a single layer in the axial direction, and the single-layer heating wire 470 is arranged in the radial direction. The single-layer structure makes the axial thickness of the heating element 400 smaller and facilitates the reduction of the size of the whole structure in the axial direction.

Figure 2:
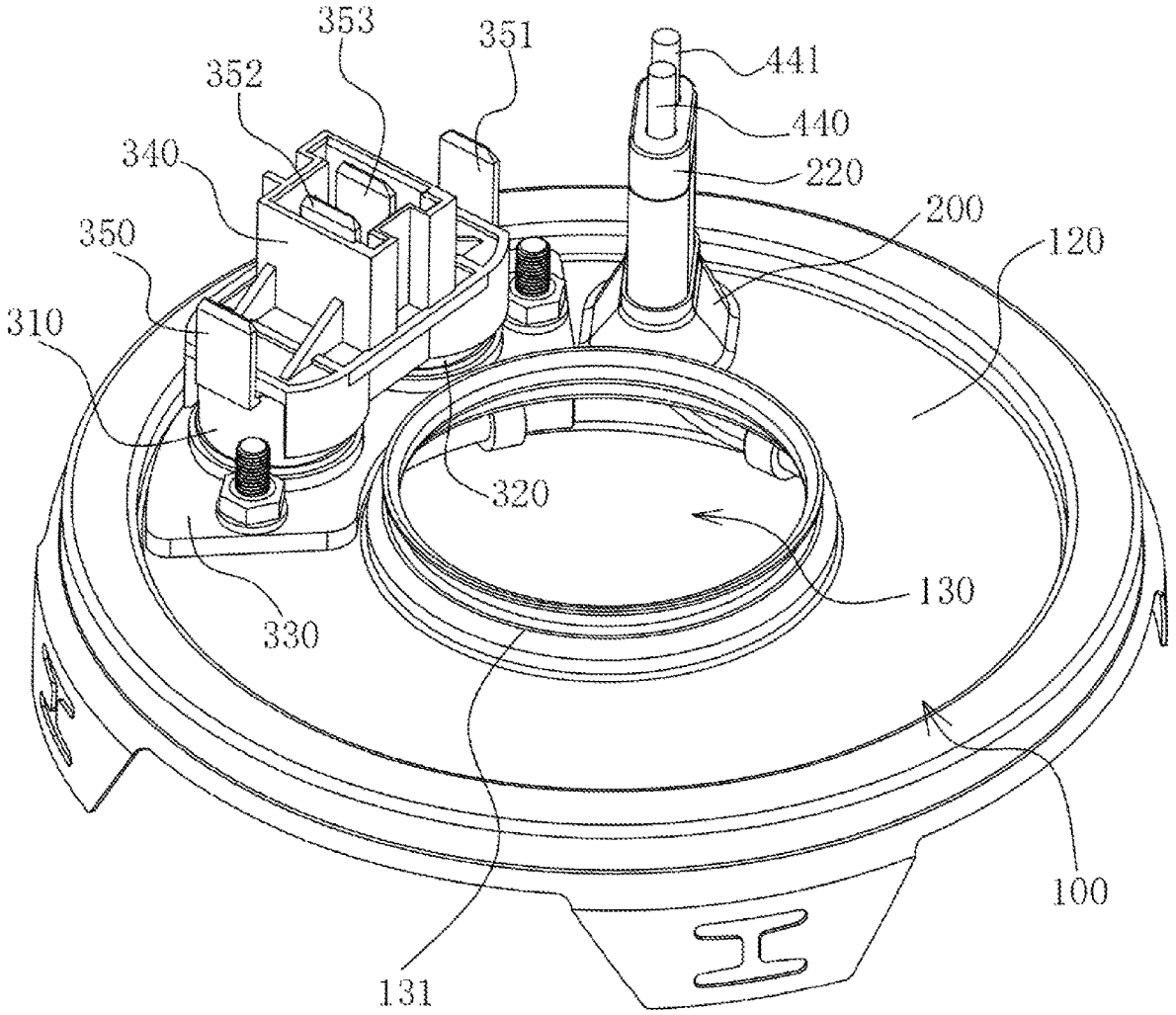
FIG. 2 is a schematic diagram of the structure of a blade-heating heat pump cover provided by an embodiment of the present disclosure.

Further, as shown in FIG. 2 and FIG. 3, the cover body 100 is provided with a convex section 200, and the second end 430 comprises a bending section 431 and an extension section 432, the bending section 431 is bent into the convex section 200 and penetrates the convex section 200 through the extension section 432. A through hole is provided in the convex section 200, and the extension section 432 of the second end 430 passes through the through hole and seals the through hole, such as the extension section 432 of the second end 430 seals the through hole by welding. In addition, one end of the extension section 432 may also have a seal 220, and the seal 220 may be made of a ceramic plug or other insulating heat-resistant material to increase the electrical strength of the electrical connection section. In a specific structure, the bending section 431 of the second end 430 is transitionally connected to the heating body area 420 of the heating element 400 along a predetermined angle, and the bending section 431 enables the second end 430 and the heating body area 420 to connect smoothly through the predetermined angle. The electrical connection section on the second end 430 is electrically connected to the temperature-controlling assembly 300, and the temperature-controlling assembly 300 is connected to an external circuit, and the electric connection part is electrically connected to energize the heating element 400, so that the temperature-controlling assembly 300 can control the circuit of the heating element 400 to be conducted or to be cut off. In addition, one side of the convex section 200 located on the first surface 110 forms a recess 210, and the bending section 431 on the second end 430 can be accommodated in the recess 210, thus facilitating the smooth connection of the second end 430 with the heating body area 420.

Further, the power density at the bending section 431 of the second end 430 of the heating element 400, and the power density at a part of the extension section 432 located inside the convex section 200 are both less than the power density at the heating body area 420, and the power density at the heating body area 420 may be the same as the power density at the heating section 412 of the first end 410. The power density at the heating element 400 is the heat generation per unit area. The power density inside the second end 430 is small, thus the heat generation is less in the same time, while the power density at the heating body area 420 of the heating element 400 is large, and thus the heat generation is more in the same time. By reducing the heat generation of the second end 430, thus balancing the unfavorable factor of the slow water flow and the poor thermal conductivity of the convex section 200 compared with the heating body area 420, thus making the working conditions of all parts of the entire heating element 400 more balanced and improving the overall life of the heating element 400.

Further, as shown in FIG. 5, the heating body area 420 of the heating element 400 and the first surface 110 are set at intervals. At least one support 421 is connected between the heating body area 420 and the first surface 110; or the heating body area 420 is welded to the first surface 110 in at least one place. By setting the support 421 or the welding structure in at least one place, the heating element 400 and the cover body 100 can be fixedly connected, so as to stabilize the heating element 400. When the heating element 400 suspended receives the impact of water flow, the heating element 400 is still stably fixed without shaking, thus reducing the noise generated by the impact of water flow on the heating element 400. The support 421 may be set as a round table, or a welding table, etc.

Figure 6:
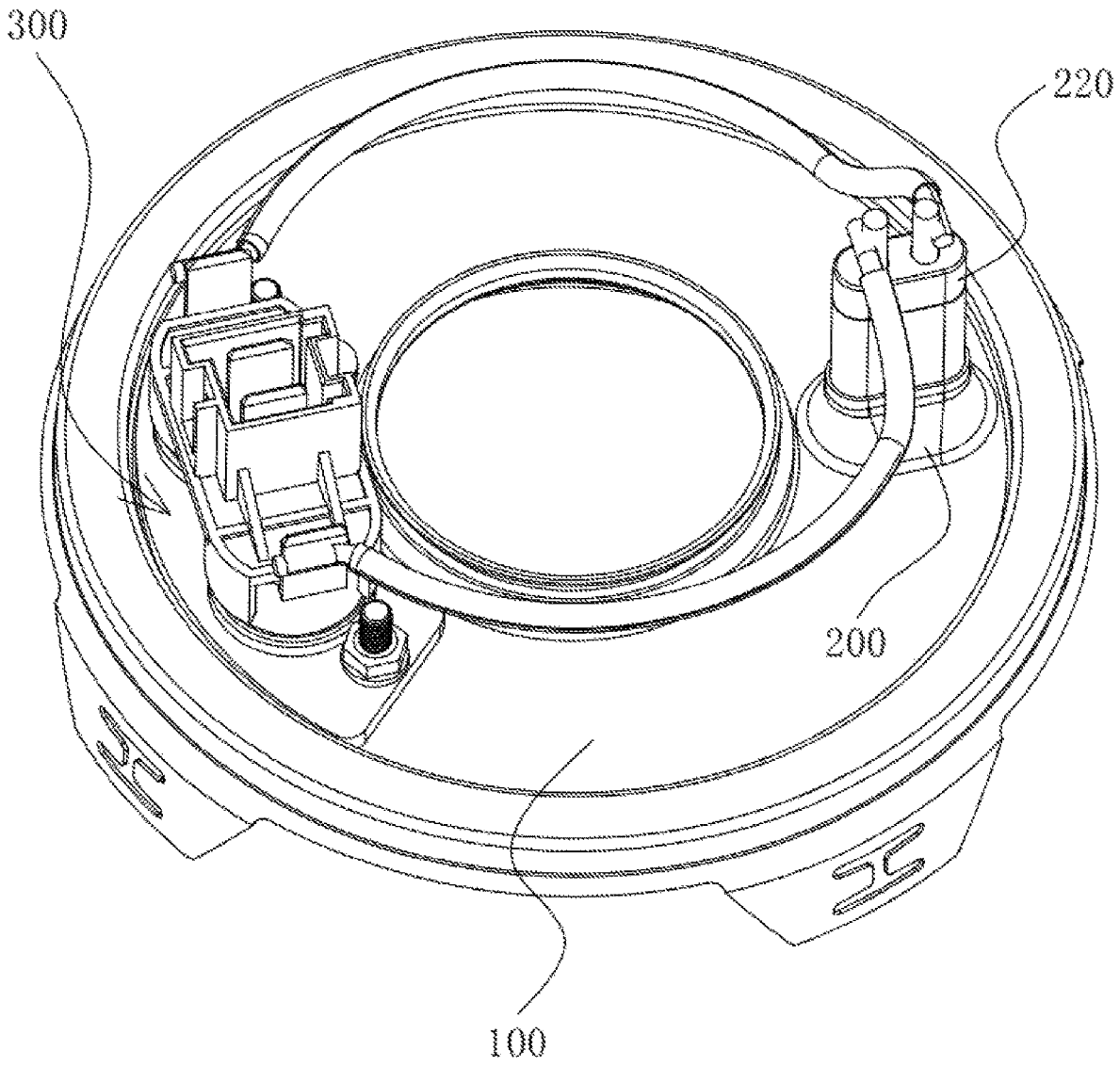
FIG. 6 is a schematic diagram of another structure of a blade-heating heat pump cover provided by an embodiment of the present disclosure.

Further, as shown in FIG. 5 and FIG. 6, the support 421 or the welding structure is set on one side of the heating body area 420 that opposite to the convex section 200 (or the second end 430). The location of the heating body area 420 that is connected to the support 421 is the connection area 411, or one or a plurality of welding structure between the heating body area 420 and the first surface 110 are the connection area 411. As shown in FIG. 6, the temperature-controlling assembly 300 can be set at the location of the connection area 411, so that the temperature-controlling assembly 300 can be set opposite the convex section 200.

Figure 7:
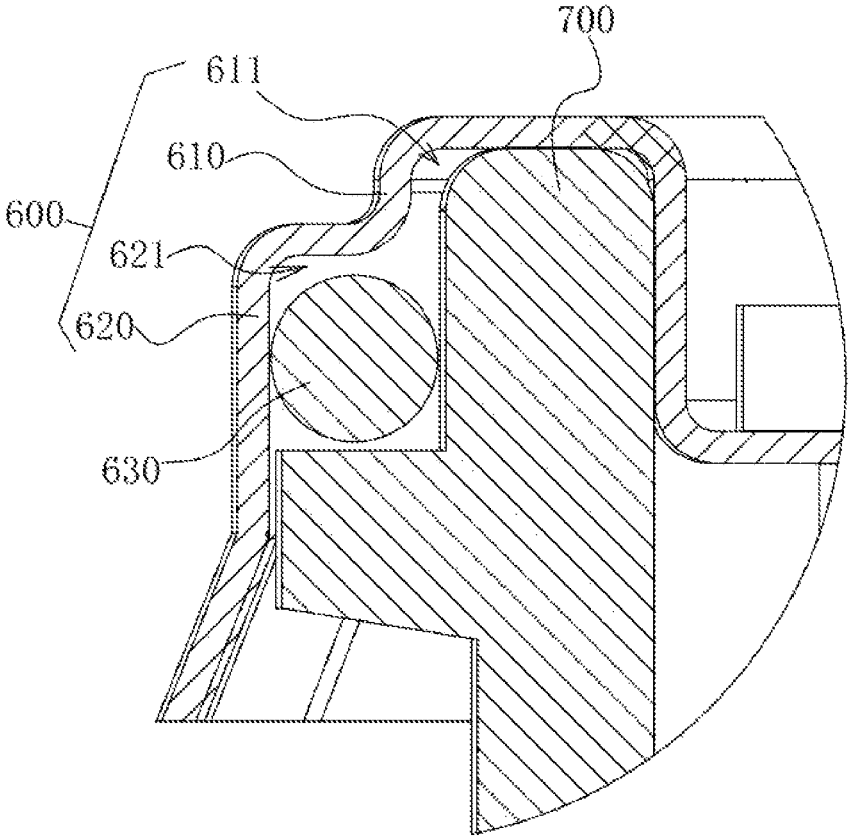
FIG. 7 is a cross-sectional view of a sealing section of a blade-heating heat pump cover provided by an embodiment of the present disclosure.

Further, as shown in FIG. 1 and FIG. 7, a sealing section 600 is provided at an edge of the cover body 100, and the sealing section 600 can be provided in various forms. As shown in FIG. 1, for example, directly in a form of an edge recess, a seal or a plurality of seals are provided inside the edge recess and embedded in the pump body 700 to achieve sealing.

Another form is shown in FIG. 7, the sealing section 600 in this embodiment is ring-shaped and has two sides in a radial direction, and one side of the sealing section 600 is connected to the cover body 100 at a predetermined angle, and the cover body 100 and the sealing section 600 are integrally formed. Another side of the sealing section 600 is bent to form a first bending section 610, and one side of the first bending section 610 that faces the cover body 100 is to form a limiting slot 611, and the limiting slot 611 is used for limiting the pump body 700. In a specific structure, the sealing section 600 is connected to an edge of the cover body 100, and an inward-facing side of the sealing section 600 is connected smoothly with an edge of the first surface 110 of the cover body 100. The side of the first bending section 610 that faces the cover body 100 is to form the limiting slot 611, so that when the pump body 700 is installed, an upper end of the pump body 700 can be directly embedded in the limiting slot 611, so that the pump body 700 is located in the limiting slot 611 without shifting in a radial direction, so as to make the installation of the pump body 700 and the heat pump cover more convenient.

Further, the sealing section 600 also comprises a second bending section 620, and the second bending section 620 is provided on an outside of the first bending section 610, and the second bending section 620 is used to buckle the pump body 700. By deforming an outer edge of the sealing section 600, and forming the second bending section 620 on the outside of the first bending section 610, and providing an installation convex table on an outer wall of the pump body 700, the second bending section 620 buckles the installation convex table, so as to achieve the second bending section 620 to buckle the pump body 700.

Further, one side of the second bending section 620 that facing the cover body 100 forms a sealing space 621, and the sealing space 621 is provided with a sealing ring 630, and the sealing ring 630 is filled between an inner wall of the second bending section 620 and an outer wall of the pump body 700. When the pump body 700 is installed in the second bending section 620, the sealing ring 630 is set on the pump body 700, and the pump body 700 and the inner wall of the second bending section 620 squeezes the sealing ring 630 in the sealing space 621, so that the sealing ring 630 fills the whole sealing space 621, thus achieving a sealing of the connection between the heat pump cover and the pump body 700, with good sealing effect, and easy disassembly and installation.

Figure 8:
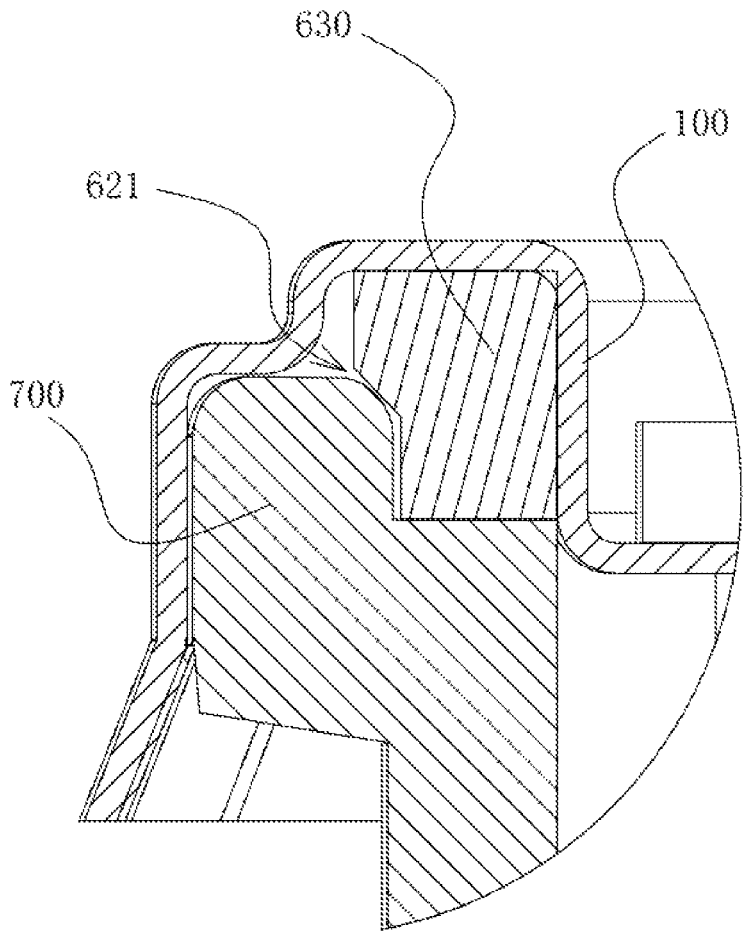
FIG. 8 is a cross-sectional view of another sealing section of a blade-heating heat pump cover provided by an embodiment of the present disclosure.

As shown in FIG. 8, a third form is forming the sealing space 621 between the pump body 700 and a side wall of the cover body 100, so that the sealing ring 630 fills the whole sealing space 621, and the sealing ring 630 is located between the pump body 700 and the side wall of the cover body 100, thus achieving a sealing on the pump body 700 and the cover body 100.

As shown in FIG. 1 and FIG. 2, the temperature-controlling assembly 300 may also comprise a temperature controller 310, wherein the temperature controller 310 senses a water temperature of one side of the cover body 100 and the heating element 400, and the temperature controller 310 is sensitive to both the water temperature and the temperature of the heating element 400, and when the water temperature reaches a preset temperature, the temperature controller 310 disconnects, thus making the heating element 400 stop heating the water in the pump, and when the water temperature in the pump is reduced to a certain temperature, the temperature controller 310 is reconnected and the heating element 400 reheats the water in the pump, thus achieving an automatic adjustment of the water temperature in the pump. In abnormal conditions such as no water or little water, the temperature controller 310 is also sensitive to the temperature of the heating element 400, so that the temperature-controlling assembly 300 acts in time to avoid causing safety accidents. And the safety device 320 (such as a fuse) is sensitive to the temperature of the heating element 400, When the heating element 400 without water is in an empty-heating state, the temperature of the connection area rises quickly, and when the temperature reaches a preset temperature of the safety device 320, the safety device 320 directly disconnected and permanently control the heating element 400 to stop working, thus avoiding damage to the integrated electric heaters of the pump for dishwashers caused by empty heating. To make the safety device 320 work again, the safety device 320 needs to be replaced again. Therefore, the temperature-controlling assembly 300 comprises the safety device 320 and the temperature controller 310, greatly improving the safety of the pump.

In addition, it should be noted that a shape contour of the temperature controller 310 and the safety device 320 in this embodiment may be cylindrical, and may also be square, triangular, and other polygonal shapes.

As shown in FIG. 2, further, the temperature-controlling assembly 300 also comprises: a fixed plate 330 and a control plug 340. The fixed plate 330 is fixed to the second surface 120, and the fixed plate 330 is a temperature-conducting plate. The temperature controller 310 is connected to the fixed plate 330, and a bottom of the temperature controller 310 is attached to the second surface 120. The safety device 320 is connected to the fixed plate 330, and a bottom of the safety device 320 is attached to the second surface 120. The control plug 340 is fixedly set on the temperature controller 310 and the safety device 320, and two sides of the control plug 340 are provided with reinforcement bars, and the first wiring post 440 and the second wiring post 441 on the heating element 400 are respectively electrically connected to a first plug 350 and a second plug 351 set on the two sides of the control plug 340 in a circuit connection. In a specific structure, the fixed plate 330 may be in the form of a bracket, or a Z-shaped bending plate, etc., and a shape of the fixed plate 330 may be set according to the realization needs. The fixed plate 330 may be connected to the cover body 100 by screws, rivets, etc., thus ensuring a close and reliable fit between the temperature controller 310 attached to the fixed plate 330 and the safety device 320 by fixing the fixed plate 330 to the cover body 100. The fixed plate 330 can be used as a heat conductor to conduct heat to the temperature-controlling assembly 300. An electrical connection section on the heating element 400 is electrically connected to the first plug 350 and the second plug 351 set on two sides of the control plug 340 to realize a series connection of the temperature controller 310, the heating element 400 and the safety device 320, so that as long as the temperature controller 310 or the safety device 320 is disconnected, the power of the heating element 400 is cut off and the heating element 400 stops heating.

The electrical connection section of the heating element 400 can be electrically connected to the first plug 350 and the second plug 351 by wires, or by a form of a connecting rod as shown in FIG. 6, the connecting rod is a rigid connecting rod and is not easily deformed.

The fixed plate 330 is provided with rivet holes adapted to the temperature controller 310 and the safety device 320, and by embedding the temperature controller 310 and the safety device 320 into the rivet holes, the temperature controller 310 and the safety device 320 form a set of modules. And just connecting the whole modules to the cover body 100 during assembly, thus facilitating the assembly of the whole temperature-controlling assembly 300.

As shown in FIG. 2, further, the control plug 340 also comprises a third plug 352 and a fourth plug 353, the third plug 352 and the fourth plug 353 are set at intervals, and the third plug 352 and the fourth plug 353 are respectively electrically connected to the temperature controller 310 and the safety device 320. The third plug 352 and the fourth plug 353 form a plug interface, and just set a connector matching the plug interface to connect with the third plug 352 and the fourth plug 353 through the connector, thus realizing a quick docking of the circuit facilitating the connection of the circuit of the heat pump cover. In addition, the third plug 352 and the fourth plug 353 can be connected to a power-supplying circuit directly by welding or by plugging through a standard terminal. The third plug 352 and the fourth plug 353 are parallel, and a distance between the third plug 352 and the fourth plug 353 is 5 mm±1 mm.

In addition, it should be noted that both the temperature controller 310 and the safety device 320 in this embodiment can be set in plurality, for example, in the form of one temperature controller 310 and two safety devices 320, the one temperature controller 310 and the two safety devices 320 are connected in series, so that by setting the two safety devices 320 in different positions of the cover body 100, a temperature conducted by the cover body 100 at different positions is sensed, thus improving the sensitivity of the temperature sensing, and improving the safety.

As shown in FIG. 2, further, a center of the cover body 100 is provided with a water inlet 130, and the water inlet 130 is provided with an enclosed edge 131, and the enclosed edge 131 is continuously arranged along a circumference of the water inlet 130. The water inlet 130 can be connected to a water-inlet pipe, to replenish water to the pump through the water-inlet pipe. The water-inlet pipe is limited by the enclosed edge 131, thus facilitating the installation of the heat pump cover and the water-inlet pipe.

The cover body 100 is provided with a plurality of grounding pieces, the grounding pieces are provided with connection holes, and the grounding pieces are fixedly attached to the cover body 100. The grounding pieces are used for grounding to conduct the electricity on the pump cover into the ground in time to improve the electrical safety of electrical appliances.

It is to be understood that the present disclosure is not limited to the embodiments described above. Modifications and variations may be resorted to in light of the above teachings by those skilled in the art, all these modifications and variations should be considered as falling within the scope of the appended claims.

What is claimed is:

1. A blade-heating heat pump cover, comprising: a cover body having a first surface in contact with liquid and a second surface opposed to the first surface, a heating element having a first end on one side of the first surface, and a second end passes through the cover body and protrudes from the second surface, wherein the second end is provided with an electrical connection section, wherein the electrical connection section is used for energizing, wherein the heating element has a connection area, and the connection area is fixedly connected to the first surface; a temperature-sensing substrate connected to the second surface; wherein the heat pump cover further comprises a temperature-controlling assembly electrically connected to the temperature-sensing substrate, and wherein a bottom of a temperature controller is attached to the second surface; wherein the temperature-controlling assembly comprises a safety device connected to the temperature-sensing substrate, and wherein a bottom of the safety device is attached to the second surface; and wherein the first end comprises a heating section and a non-heating section, wherein the non-heating section is on one side of the heating section away from the second end, and the non-heating section is connected to the heating section.

2. The blade-heating heat pump cover according to claim 1, wherein a length of the non-heating section is 2 mm-80 mm.

3. The blade-heating heat pump cover according to claim 1, wherein the heating section is the connection area, wherein the heating section is fixedly connected to the first surface.

4. The blade-heating heat pump cover according to claim 3, wherein the heating section is welded to the first surface or is fixedly connected to the first surface by a temperature-sensing layer.

5. The blade-heating heat pump cover according to claim 3, wherein the electrical connection section comprises a first wiring post and a second wiring post;

wherein the heating element comprises a heating sheath and a heating wire inside the heating sheath, two ends of the heating wire are respectively connected to the first wiring post and the second wiring post.

6. The blade-heating heat pump cover according to claim 5, wherein the temperature-controlling assembly further comprises a control plug fixedly set on the temperature controller and the safety device, wherein two sides of the control plug are respectively provided with reinforcement bars, wherein the first wiring post and the second wiring post are respectively electrically connected to a first plug and a second plug set on the two sides of the control plug in a circuit connection; and wherein the control plug also comprises a third plug and a fourth plug, wherein the third plug and the fourth plug are set at intervals, wherein the third plug and the fourth plug are respectively electrically connected to the temperature controller and the safety device.

7. The blade-heating heat pump cover according to claim 1, wherein the heating element has a heating body area, wherein the heating body area is provided between the first end and the second end, wherein the heating body area of the heating element and the first surface are set at intervals, wherein the heating body area and the first surface are connected by one support or a plurality of supports.

8. The blade-heating heat pump cover according to claim 7, wherein a position of the heating body area connected to the supports is the connection area.

9. The blade-heating heat pump cover according to claim 1, wherein the heating body area of the heating element and the first surface are set at intervals, wherein at least one welded position is between the heating body area and the first surface, wherein the welded position of the heating body area is the connection area.

10. The blade-heating heat pump cover according to claim 1, wherein the non-heating section is connected to the first surface or is set at intervals with the first surface.

11. The blade-heating heat pump cover according to claim 1, wherein a length of the heating element along a radial direction is greater than a length of the heating element along an axial direction.

12. The blade-heating heat pump cover according to claim 11, wherein a ratio of the length of the heating element along the radial direction to the length of the heating element along the axial direction is not less than 2.3.

13. The blade-heating heat pump cover according to claim 1, wherein the heating element has a heating body area, wherein the heating body area is provided between the first end and the second end, wherein the heating body area and the first end form a contour in a shape of an open ring;

wherein the heating element has a connecting reinforcement connected between a bending section of the second end and the first end, wherein the connecting reinforcement is located at an opening between the heating body area and the first end.

14. The blade-heating heat pump cover according to claim 1, wherein the cover body is provided with a convex section, wherein the second end comprises a bending section and an extension section, wherein the bending section is bent into the convex section and penetrates the convex section by the extension section, wherein the extension section of the second end is sealingly connected to a penetration of the convex section.

15. The blade-heating heat pump cover according to claim 14, wherein a power density at the bending section and a power density at a part of the extension section inside the convex section are both less than a power density at the heating section.

16. A heat pump comprising: a pump body, and a heat pump cover according to claim 1; wherein the heat pump cover is detachably connected to the pump body.

* * * * *